US008479973B2

(12) United States Patent
Brand

(10) Patent No.: US 8,479,973 B2
(45) Date of Patent: Jul. 9, 2013

(54) CARTON WITH HANDLE

(75) Inventor: Kirsten L. Brand, Hackensack, NJ (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 13/344,777

(22) Filed: Jan. 6, 2012

(65) Prior Publication Data

US 2012/0199638 A1 Aug. 9, 2012

Related U.S. Application Data

(60) Provisional application No. 61/460,803, filed on Jan. 7, 2011.

(51) Int. Cl.
*B65D 5/468* (2006.01)

(52) U.S. Cl.
USPC ..... 229/117.16; 229/117.13

(58) Field of Classification Search
USPC ..... 229/117.13, 117.14, 117.16, 117.17; 206/141, 427
See application file for complete search history.

(56) References Cited

U.S. PATENT DOCUMENTS

| | | | | |
|---|---|---|---|---|
| 2,196,502 | A | | 4/1940 | Kells |
| 2,308,050 | A | | 1/1943 | Burr |
| 2,386,905 | A | | 10/1945 | Meitzen |
| 2,648,484 | A | | 8/1953 | Belsinger |
| 2,661,142 | A | * | 12/1953 | Hendrickson, Jr. ..... 229/117.14 |
| 2,718,301 | A | | 9/1955 | Palmer |
| 2,785,847 | A | | 3/1957 | Forrer |
| 2,900,123 | A | | 8/1959 | Drnec et al. |
| 3,160,326 | A | * | 12/1964 | Sturdevant et al. ..... 229/117.13 |
| 3,173,596 | A | | 3/1965 | Aust et al. |
| 3,756,499 | A | | 9/1973 | Giebel et al. |
| 4,005,815 | A | | 2/1977 | Nerenberg et al. |
| 4,538,759 | A | | 9/1985 | Dutcher |
| 4,558,816 | A | | 12/1985 | Wood |
| 4,621,766 | A | | 11/1986 | McClure |
| 4,653,686 | A | | 3/1987 | Wood et al. |
| 4,681,252 | A | | 7/1987 | Doerr et al. |
| 4,684,059 | A | | 8/1987 | Rusnock |

(Continued)

FOREIGN PATENT DOCUMENTS

| | | |
|---|---|---|
| EP | 0870688 A1 | 10/1998 |
| JP | 54-026529 | 2/1979 |

(Continued)

OTHER PUBLICATIONS

International Search Report and Written Opinion for PCT/US2012/020417 dated Jul. 31, 2012.

*Primary Examiner* — Gary Elkins
(74) *Attorney, Agent, or Firm* — Womble Carlyle Sandridge & Rice, LLP

(57) ABSTRACT

A carton for containing a plurality of articles. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels, wherein the end flaps are at least partially overlapped with respect to one another and thereby at least partially form a closed end of the carton. A handle extends in at least the closed end of the carton. The handle comprises a first handle portion adjacent the top panel and a second handle portion adjacent the bottom panel.

27 Claims, 4 Drawing Sheets

U.S. PATENT DOCUMENTS

| | | | | |
|---|---|---|---|---|
| 4,706,876 | A | 11/1987 | Wilson | |
| 4,728,025 | A | 3/1988 | Oliff | |
| 4,728,026 | A | 3/1988 | Schuster | |
| 4,784,316 | A | 11/1988 | Crouch | |
| 4,785,991 | A | 11/1988 | Schuster | |
| 4,811,894 | A | 3/1989 | Schuster | |
| 4,838,479 | A | 6/1989 | Wood | |
| RE33,110 | E | 11/1989 | Wood et al. | |
| 4,958,734 | A | 9/1990 | Wood et al. | |
| 4,966,324 | A | 10/1990 | Steel | |
| 4,972,991 | A | 11/1990 | Schuster | |
| 4,974,771 | A | 12/1990 | Lavery | |
| 4,981,253 | A | 1/1991 | Quaintance | |
| 5,000,313 | A | 3/1991 | Oliff | |
| 5,002,186 | A | 3/1991 | Cooper | |
| 5,072,876 | A | 12/1991 | Wilson | |
| 5,106,014 | A | 4/1992 | Miller | |
| 5,108,030 | A | 4/1992 | Schuster et al. | |
| 5,119,985 | A | 6/1992 | Dawson et al. | |
| 5,222,658 | A | 6/1993 | DeMaio et al. | |
| 5,292,059 | A | 3/1994 | Oliff | |
| 5,307,932 | A | 5/1994 | Stout et al. | |
| 5,333,734 | A | 8/1994 | Stout et al. | |
| 5,350,109 | A | 9/1994 | Brown et al. | |
| 5,379,944 | A | 1/1995 | Stout et al. | |
| 5,385,234 | A | 1/1995 | Stout et al. | |
| 5,480,091 | A | 1/1996 | Stout | |
| 5,482,203 | A | 1/1996 | Stout | |
| 5,588,585 | A | 12/1996 | McClure | |
| 5,794,778 | A | 8/1998 | Harris | |
| 5,826,783 | A | 10/1998 | Stout | |
| 5,906,313 | A | 5/1999 | Oliff | |
| 5,996,883 | A | 12/1999 | Bates | |
| 6,021,899 | A | 2/2000 | Sutherland | |
| 6,109,438 | A | 8/2000 | Sutherland | |
| 6,112,977 | A | 9/2000 | Sutherland et al. | |
| 6,126,066 | A | 10/2000 | Peterson et al. | |
| 6,170,741 | B1 | 1/2001 | Skolik et al. | |
| 6,237,839 | B1 | 5/2001 | Brown | |
| 6,237,840 | B1 * | 5/2001 | Grabowski et al. | 229/117.16 |
| 6,250,542 | B1 | 6/2001 | Negelen | |
| 6,273,330 | B1 | 8/2001 | Oliff et al. | |
| 6,378,733 | B1 * | 4/2002 | Boonzaier | 229/117.13 |
| 6,425,520 | B1 | 7/2002 | Peterson | |
| 6,595,411 | B2 | 7/2003 | McClure | |
| 6,631,803 | B2 | 10/2003 | Rhodes et al. | |
| 6,708,874 | B1 * | 3/2004 | Montgomery | 229/117.16 |
| 6,766,940 | B2 | 7/2004 | Negelen | |
| 6,848,573 | B2 | 2/2005 | Gould et al. | |
| 6,968,992 | B2 | 11/2005 | Schuster | |
| 7,273,161 | B2 | 9/2007 | Fogle et al. | |
| 7,552,857 | B2 | 6/2009 | Harrelson | |
| 7,743,968 | B2 | 6/2010 | Theelen | |
| 7,757,933 | B2 | 7/2010 | Dunn | |
| 7,775,418 | B2 | 8/2010 | Walling | |
| 7,780,067 | B2 | 8/2010 | Holley, Jr. | |
| 7,832,622 | B2 | 11/2010 | Spivey, Sr. | |
| 7,984,843 | B2 | 7/2011 | Cooper et al. | |
| 7,984,845 | B2 * | 7/2011 | Kelly | 229/242 |
| 7,998,047 | B2 | 8/2011 | Spivey, Sr. et al. | |
| 2004/0074954 | A1 | 4/2004 | Fogle et al. | |
| 2005/0087592 | A1 | 4/2005 | Schuster | |
| 2005/0189405 | A1 | 9/2005 | Gomes et al. | |
| 2005/0263574 | A1 | 12/2005 | Schuster | |
| 2006/0081691 | A1 | 4/2006 | Smalley | |
| 2006/0278689 | A1 | 12/2006 | Boshinski et al. | |
| 2007/0017962 | A1 | 1/2007 | Russ | |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2007/0137222 | A1 * | 6/2007 | Kastanek et al. | 220/592.2 |
| 2010/0025457 | A1 | 2/2010 | Cooper et al. | |

FOREIGN PATENT DOCUMENTS

| | | |
|---|---|---|
| JP | 62-93014 | 6/1987 |
| JP | 3-014449 A | 1/1991 |
| JP | 3-84717 | 8/1991 |
| WO | WO 99/28198 | 6/1999 |

* cited by examiner

CARTON WITH HANDLE

CROSS-REFERENCE TO RELATED APPLICATIONS

This application claims the benefit of U.S. Provisional Patent Application No. 61/460,803, filed Jan. 7, 2011.

INCORPORATION BY REFERENCE

The disclosure of U.S. Provisional Patent Application No. 61/460,803, which was filed on Jan. 7, 2011, is hereby incorporated by reference for all purposes as if presented herein in its entirety.

BACKGROUND OF THE DISCLOSURE

The present disclosure generally relates to cartons for holding and dispensing articles.

SUMMARY OF THE DISCLOSURE

In general, one aspect of the disclosure is directed to a carton for containing a plurality of articles. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels, wherein the end flaps are at least partially overlapped with respect to one another and thereby at least partially form a closed end of the carton. A handle extends in at least the closed end of the carton. The handle comprises a first handle portion adjacent the top panel and a second handle portion adjacent the bottom panel.

In another aspect, the disclosure is generally directed to a blank for forming a carton. The blank comprises a plurality of panels comprising a top panel, a bottom panel, a first side panel, and a second side panel. At least two end flaps are respectively foldably connected to respective panels of the plurality of panels. The at least two end flaps are for being at least partially overlapped with respect to one another to at least partially form a closed end of the carton formed from the blank. The blank can also include handle features for forming a handle extending in at least the closed end of the carton formed from the blank. The handle features comprise a first handle portion adjacent the top panel and a second handle portion adjacent the bottom panel.

In yet another aspect, the disclosure is generally directed to a method of forming a carton. The method comprises obtaining a blank comprising a plurality of panels comprising a top panel, a bottom panel, a first side panel, and a second side panel, at least two end flaps respectively foldably connected to respective panels of the plurality of panels, and handle features extending in at least the at least two end flaps. The method further comprises forming an interior of the carton at least partially defined by the plurality of panels. The forming the interior of the carton comprises forming an open-ended sleeve. The method can also comprise positioning the at least two end flaps to be at least partially overlapped with respect to one another to at least partially close an end of the open-ended sleeve. The positioning the at least two end flaps comprising positioning the handle features to form a handle in the closed end with a first handle portion adjacent the top panel and a second handle portion adjacent the bottom panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure generally relates to cartons housing a plurality of articles and a dispenser in the carton for removing articles from the carton. The present disclosure can be used, for example, in cartons that contain articles or other products such as, for example, food and beverages or pet food. The articles can also include soup cans or other food or beverage containers such as, for example, cans, bottles, PET containers, or other containers such as those used in packaging foodstuffs. For the purposes of illustration and not for the purpose of limiting the scope of the present disclosure, the following detailed description describes generally cylindrical beverage containers as disposed within the carton embodiments. In this specification, the relative terms "lower," "bottom," "upper" and "top" indicate relative orientations determined in relation to fully erected cartons.

Figure 1:
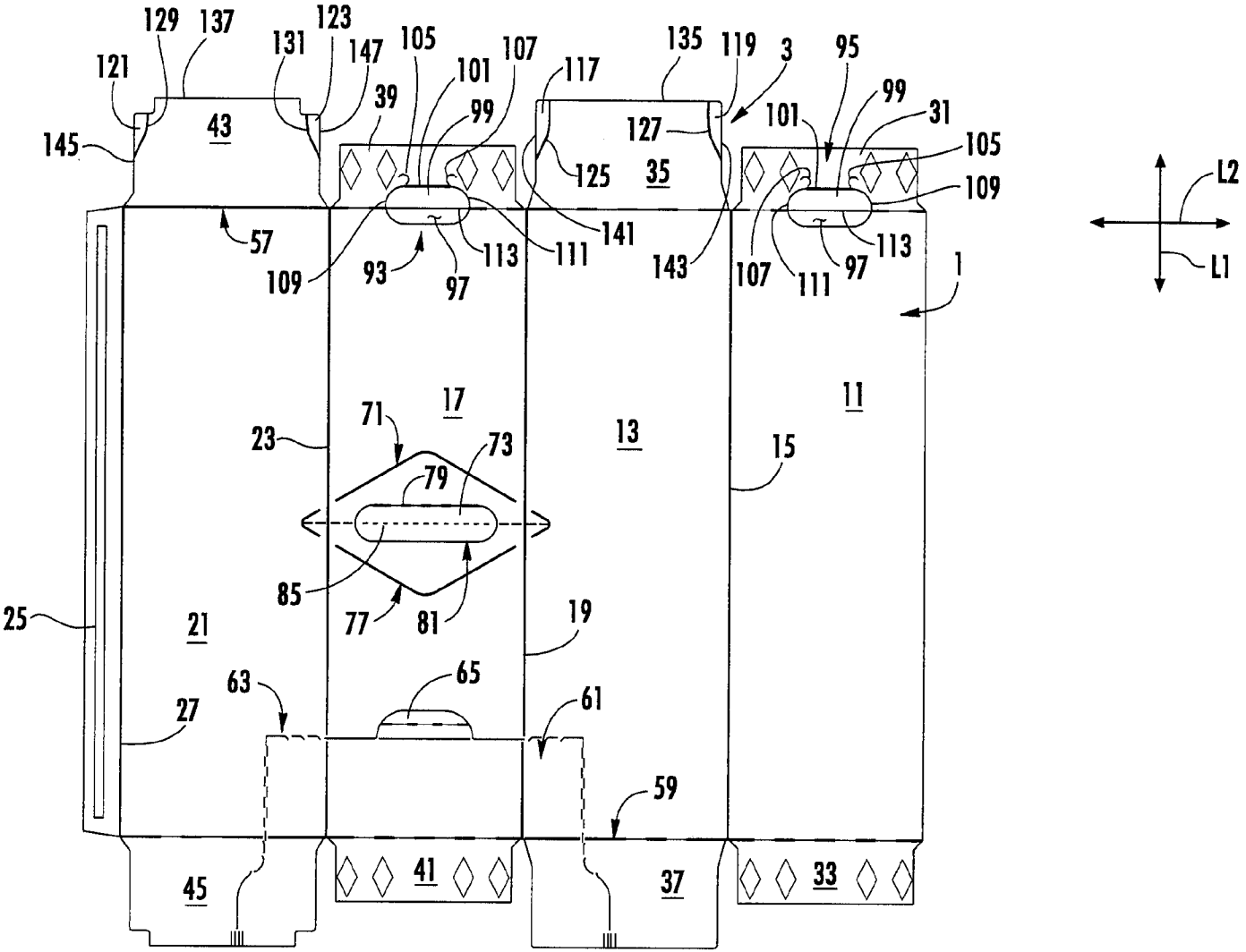
FIG. 1 is an interior plan view of a blank for forming a carton according to an exemplary embodiment of the disclosure.

FIG. 1 is a plan view of the interior side 1 of a blank, generally indicated at 3, used to form a carton 5 (FIG. 3) according to the exemplary embodiment of the disclosure. The carton 5 can be used to house a plurality of articles such as containers C. The carton 5 has a dispenser, generally indicated at 7, formed in the carton for allowing access to the containers C. In the illustrated embodiment, the carton 5 also includes a first handle 71 and a second handle 91 (FIG. 3) for grasping and carrying the carton 5 from the top and/or the end. In the illustrated embodiment, the carton 5 is sized to hold twelve containers C arranged in a single layer in a 2×6 arrangement, but it is understood that the carton 5 may be sized and shaped to hold containers C of a different or same quantity in more than one layer and/or in different row/column arrangements (e.g., 1×12, 3×6, 2×6×2, 3×4×2, etc.)

The blank 3 has a longitudinal axis L1 and a lateral axis L2. In the illustrated embodiment, the blank 3 comprises a bottom panel 11 foldably connected to a first side panel 13 at a first longitudinal fold line 15, a top panel 17 foldably connected to the first side panel 13 at a second longitudinal fold line 19, and a second side panel 21 foldably connected to the top panel 17 at a third longitudinal fold line 23. An adhesive flap 25 is foldably connected to the second side panel 21 at a fourth longitudinal fold line 27.

In one embodiment, the bottom panel 11 is foldably connected to a first bottom end flap 31 and a second bottom end flap 33. The first side panel 13 is foldably connected to a first side end flap 35 and a second side end flap 37. The top panel 17 is foldably connected to a first top end flap 39 and a second top end flap 41. The second side panel 21 is foldably connected to a first side end flap 43 and a second side end flap 45. When the carton 5 is erected, the top and bottom end flaps 39, 31 and side end flaps 35, 43 close a first end 51 of the carton, and the top and bottom end flaps 41, 33 and side end flaps 37, 45 close a second end 53 of the carton. In accordance with an alternative embodiment of the present disclosure, different flap arrangements can be used for closing the ends 51, 53 of the carton.

As shown in FIG. 1, the end flaps 31, 35, 39, 43 extend along a first marginal area of the blank 3, and can be foldably connected at a first lateral fold line 57 that extends along the width of the blank. The end flaps 33, 37, 41, 45 extend along a second marginal area of the blank 3, and can be foldably connected at a second lateral fold line 59 that also extends along the width of the blank. The lateral fold lines 57, 59 may be, for example, substantially straight, or offset at one or more locations to account for blank thickness or for other factors. The blank 3 could have other end flap arrangement without departing from the disclosure.

In one embodiment, the dispenser 7 includes a dispenser panel, generally indicated at 61, removably attached to the blank 3 at a tear line, generally indicated at 63. When the dispenser panel 61 is removed from the carton 5, a dispenser opening (not shown) is exposed that allows the containers C to be selectively dispensed from the carton. In the illustrated embodiment, the dispenser panel 61 includes portions of the first side panel 13, the top panel 17, the second side panel 21, the top end flap 41, the side end flap 37, and the side end flap 45. The dispenser panel 61 and the tear line 63 could be otherwise shaped, arranged, or configured without departing from the disclosure. In the illustrated embodiment, the dispenser panel 61 includes an access flap 65 in the top panel 17. The dispenser 7 could be otherwise shaped, arranged, configured, and/or omitted without departing from the disclosure.

In the illustrated embodiment, the first handle 71 extends in the top panel 17. The first handle 71 can be any type of suitable or conventional handle. In the illustrated embodiment, the handle 71 comprises an elongate handle flap 73 formed in the top panel 17 and a diamond-shaped crease 77 in the top panel and the first and second side panels 13, 21. The handle flap 73 is foldably attached to the top panel 17 at lateral fold line 79 and is defined by a cut or tear line 81. A lateral fold line 85 bisects the handle flap 73 and diamond-shaped crease 77 and extends across the top panel 17 and into both the side panels 13, 21 to facilitate activation of the first handle 71. The handle 71 may be activated by pressing on the handle flap 73 and folding the handle flap down (e.g., inward) to form an opening (not shown) in the carton 5. The opening is shaped for insertion of a user's fingers during grasping of the carton 5. The handle 71 is longitudinally spaced in the top panel 17 such that the handle flap 73 is generally centered in the top panel between the lateral fold lines 57, 59 of the blank 3. It is understood that the handle 71 may be otherwise shaped, arranged, configured, and/or located without departing from the scope of this disclosure. Further, the first handle 71 could be omitted without departing from the scope of the disclosure.

In the illustrated embodiment, the blank 3 includes features for forming a second handle 91 in the first end 51 of the carton 5. The features that form the second handle 91 include a first handle portion 93 in the top panel 17 and the top end flap 39, and a second handle portion 95 in the bottom panel 11 and bottom end flap 31. In the illustrated embodiment, the first handle portion 93 and the second handle portion 95 are similar or generally identical, but the handle portions could be otherwise shaped, arranged, configured, and/or omitted without departing from the disclosure. Accordingly, only the first handle portion 93 is described in detail, but the second handle portion 95 has similar or generally identical features that are indicated by identical reference numbers.

As shown in FIG. 1, the handle portion 93 includes an access opening 97 in the top panel 17, and a handle flap 99 adjacent the access opening. The handle flap 99 is foldably connected to the end flap 39 by a lateral fold line 101. The lateral fold line 101 extends between two J-shaped or hook cuts 105, 107 in the end flap 39. In the illustrated embodiment, the handle flap 99 is at least partially defined by two curved cuts 109, 111 extending from respective ends of the fold line 101 to a free edge 113 of the handle flap 99. In the illustrated embodiment, the free edge 113 of the handle flap 99 is straight and is generally aligned with and extending between respective portions of the lateral fold line 57 at the foldable connection of the top end flap 39 and the top panel 17. The handle portion 93 could be otherwise shaped, arranged, and/or configured without departing from the disclosure.

In the illustrated embodiment, the features for forming the second handle 91 include handle flaps 117, 119 in the side end flap 35 and handle flaps 121, 123 in the side end flap 43. The handle flaps 117, 123 form a portion of the first handle portion 93, and the handle flaps 119, 121 form a portion of the second handle portion 95. Each handle flap 117, 119, 121, 123 comprises a respective corner at the free edge of a respective side end flap 35, 43. Each handle flap 117, 119, 121, 123 is foldably connected to a respective side end flap 35, 43 at a respective curved fold line 125, 127, 129, 131. In the illustrated embodiment, each of the fold lines 125, 127 extends from a free, laterally extending edge 135 of the side end flap 35 to a respective free, longitudinally extending edge 141, 143 of the side end flap 35, and each of the fold lines 129, 131 extends from a free, laterally extending edge 137 of the side end flap 43 to a respective free, longitudinally extending edge 145, 147 of the side end flap 43. The handle flaps 117, 119, 121, 123, could be otherwise shaped, arranged, configured, and/or omitted without departing from the scope of the disclosure.

Figure 2:
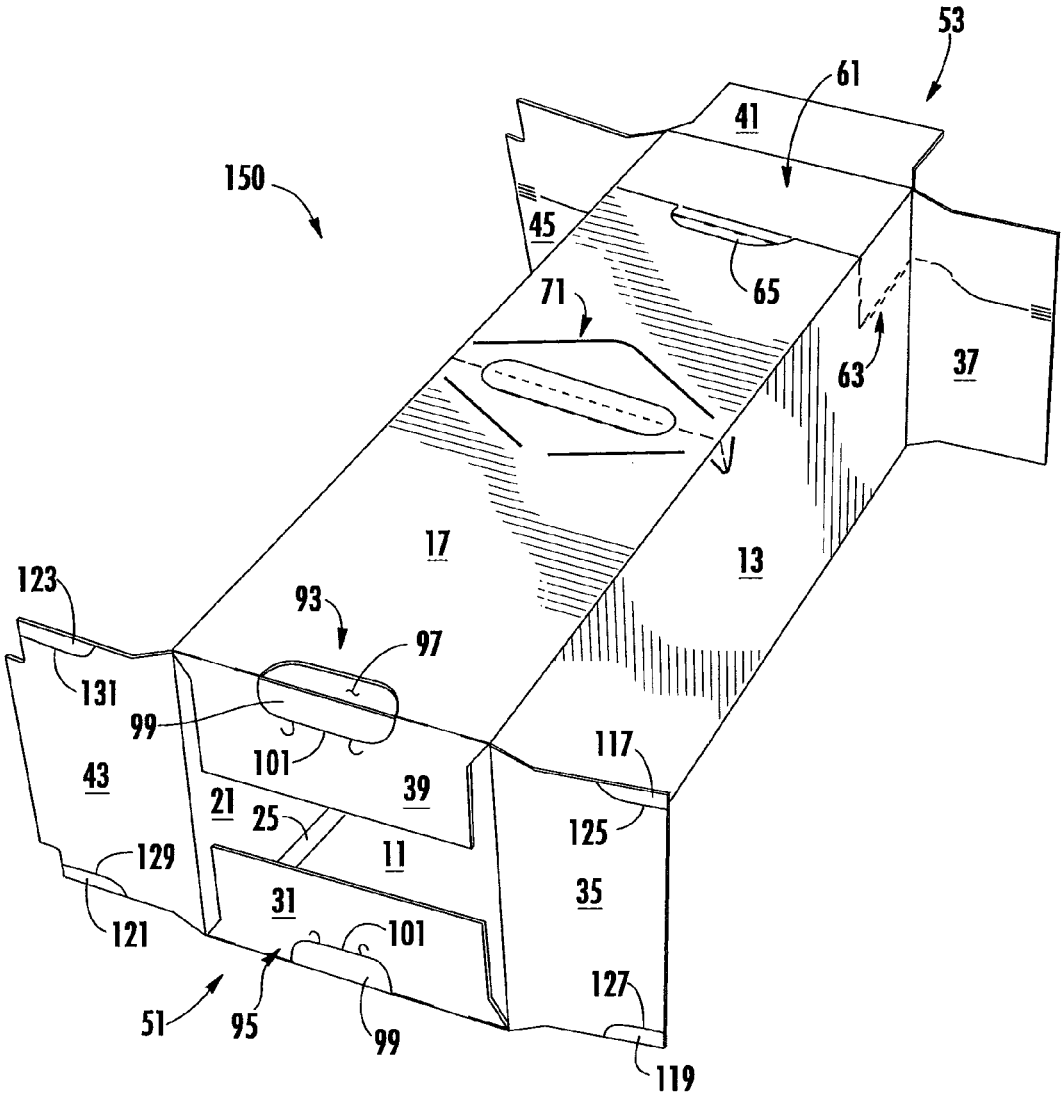
FIG. 2 is a perspective view of a partially-formed carton according to the exemplary embodiment of the disclosure.

In accordance with the exemplary embodiment, the blank 3 can be erected into the carton 5 by folding along fold lines 15, 19, 23, 27 and adhering the adhesive flap 25 to the bottom panel 11 to form an open-ended sleeve 150 (FIG. 2). The ends 51, 53 of the carton 5 can be closed by respectively overlapping and adhering the end flaps 31, 35, 39, 43 at one end and the end flaps 33, 37, 41, 45 at the other end after the containers C are inserted into the carton. Alternatively, one of the ends 51, 53 can be closed before inserting the containers C into the carton 5 and the other of the ends can be closed after inserting the containers in the carton. In the illustrated embodiment, top and bottom end flaps 31, 39, 33, 41 are closed first and the side end flaps 35, 43, 37, 45 are closed next so that the side end flaps overlap the top and bottom end flaps at each end 51, 53. As shown in FIG. 2, for example, the top and bottom end flaps 39, 31 are folded over the end 51 of the open-ended sleeve 150 prior to folding the side end flaps 35, 43 over the end 51. It is understood that closing configurations that differ than the closing configurations discussed herein are within the scope of the disclosure.

Figure 3:
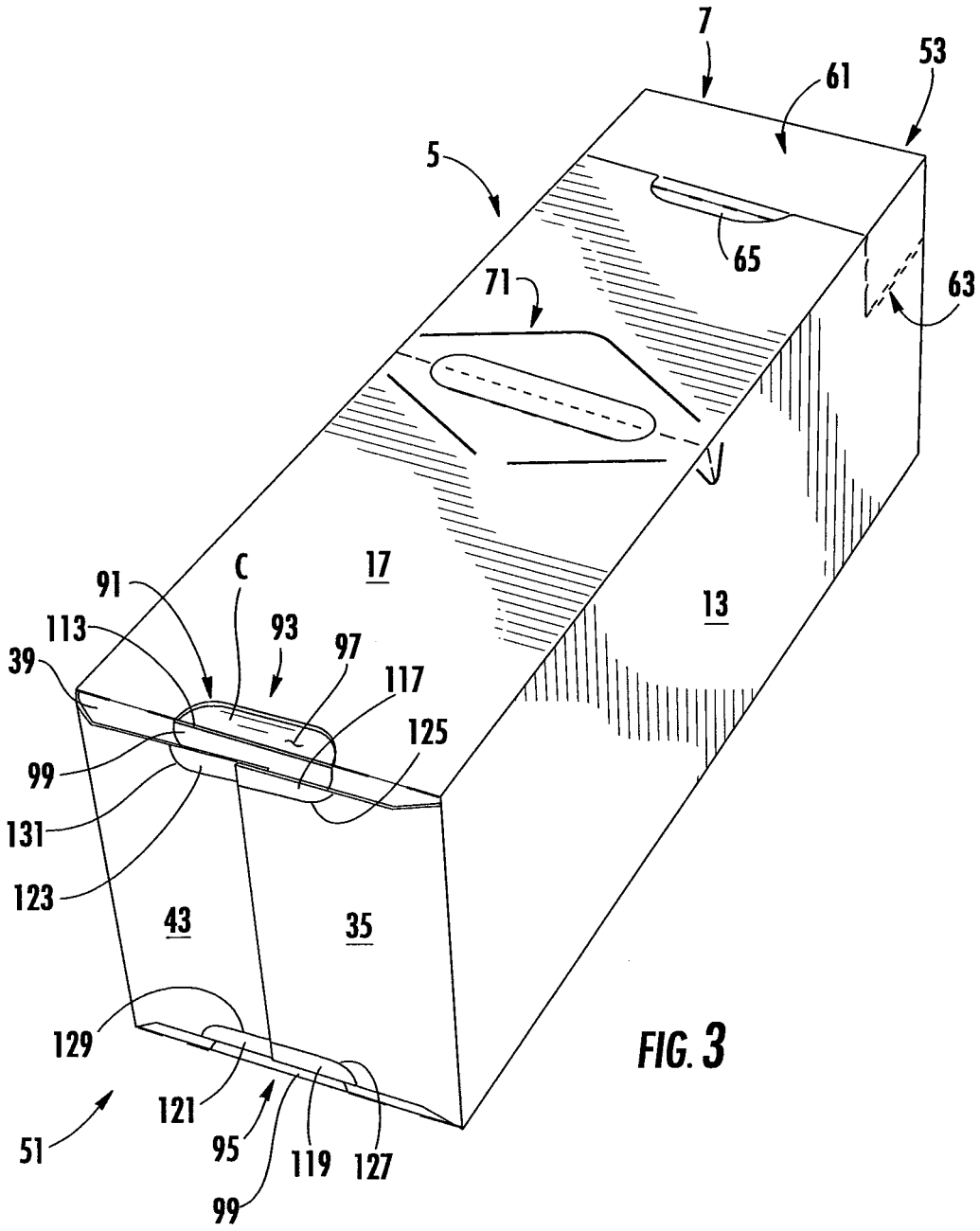
FIG. 3 is a perspective of the carton formed from the blank of FIG. 1.

The assembled carton 5 is shown in FIG. 3. When the end 51 is closed, the handle flaps 117, 123 at least partially overlap the handle flap 99 of the handle portion 93, and the curved fold lines 125, 131 at least partially overlap the fold line 101 of the handle portion 93. In addition, the handle flaps 119, 121 at least partially overlap the handle flap 99 of the handle portion 95, and the curved fold lines 127, 129 at least partially overlap the fold line 101 of the handle portion 95. In the illustrated embodiment, the side end flap 35 partially overlaps the side end flap 43 so the handle flaps 117, 119 partially overlap the respective handle flaps 123, 121. Alternatively, the end 51 could be configured so that the handle flaps 123, 121 at least partially overlap the respective handle flaps 117, 119, or the handle flaps 117, 119 could be disposed adjacent the respective handle flaps 123, 121. Further, the end 51 and the second handle 91 could be alternatively configured so that the top and bottom end flaps 39, 31 are external to the side end flaps 35, 43 so that the handle flaps 99 overlap the handle flaps 117, 119, 121, 123.

Figure 4:
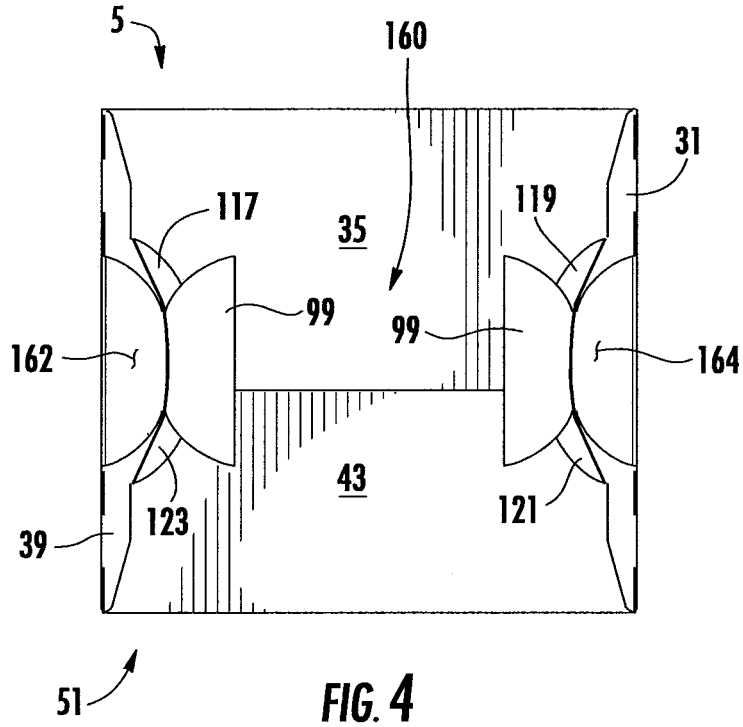
FIGS. 4 and 5 are end views of the carton of FIG. 3 after activation of a handle in a closed end according to the exemplary embodiment of the disclosure.
Figure 5:
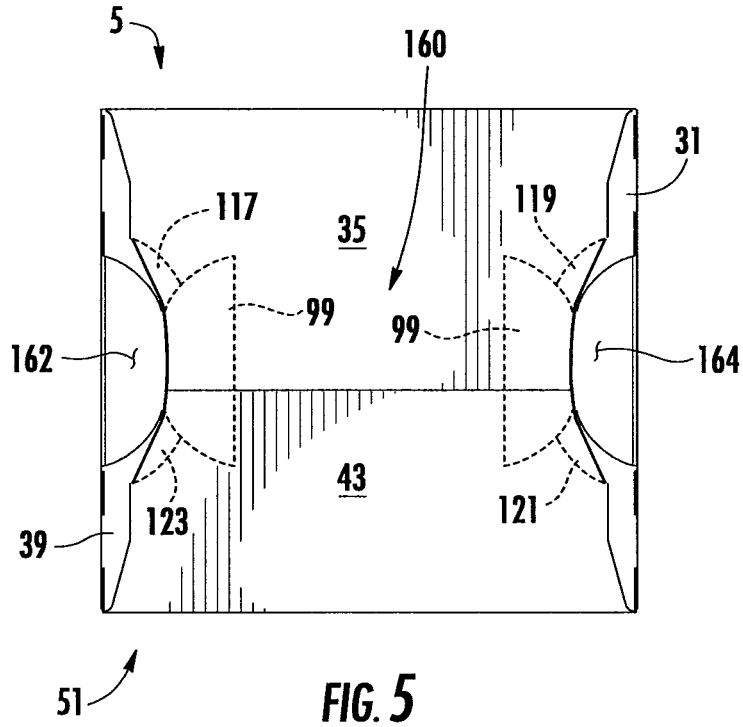

The carton 5 can be carried by grasping the first handle 71 in the top panel 17. Alternatively, the carton 5 can be carried by grasping the second handle 91 in the closed end 51. A user can place finger or fingers through the access opening 97 of each handle portion 93, 95 and fold the respective handle panels 99 outwardly to facilitate grasping the carton 5 at the closed end 51. As shown by way of example in FIG. 4, the handle flaps 99, 117, 119, 121, 123 can be folded over the exterior surface of a central portion 160 of the end 51. Accordingly, the access openings 97 of the handle portions 93, 95 form a first handle opening 162 in the top panel 17 and the end 51 and a second handle opening 164 in the bottom panel 11 and the end 51. A user can then grasp the central portion 160 of the end 51 at the handle openings 162, 164. Alternatively, as shown by way of example in FIG. 5, the handle flaps 99, 117, 119, 121, 123 can be inwardly folded to form the handle openings 162, 164 to facilitate grasping the carton 5 at the second handle 91. In FIG. 5, the handle flaps 99, 117, 119, 121, 123 are interior to the central portion 160 and are hidden by the end flaps 31, 35, 39, 43. Accordingly, the handle flaps 99, 117, 119, 121, 123 are drawn in phantom lines. In one example, the first handle 71 could be out of reach or otherwise inaccessible, and a user can grasp the second handle 91 to pull the carton 5 off from a shelf or to otherwise move the carton 5. The carton 5 can be carried by other steps or methods without departing from the disclosure.

The dispenser panel 61 may be removed from the carton 5 to form the dispenser opening (not shown) in the closed end 53. An exemplary opening process can begin with grasping the access flap 65 and tearing the dispenser panel 61 along the tear line 63. After separation and removal of the dispenser panel 61, containers C can be removed through the dispenser opening at the end 53 of the carton 5.

The present disclosure can be used in cartons that include various features, including additional opening features that provide easy access to the articles and tilt features that position the articles at the front or rear end of the carton.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A carton for containing a plurality of articles, the carton comprising:

a plurality of panels that extends at least partially around an interior of the carton, the plurality of panels comprising a top panel, a bottom panel, a first side panel, and a second side panel;

at least two end flaps respectively foldably connected to respective panels of the plurality of panels, the at least two end flaps being at least partially overlapped with respect to one another and thereby at least partially form a closed end of the carton; and a handle extending in at least the closed end of the carton, the handle comprising a first handle portion adjacent the top panel and a second handle portion adjacent the bottom panel;

wherein at least one of the first handle portion and the second handle portion comprise an access opening and a handle flap; the access opening being in one of the top panel and the bottom panel.

2. The carton of claim 1, wherein the handle flap comprises a plurality of handle flaps; each of the first handle portion and the second handle portion comprises the plurality of handle flaps foldably connected to the closed end of the carton.

3. The carton of claim 2, wherein:

the access opening comprises a first access opening and a second access opening;

the first handle portion comprises the first access opening in at least the top panel, at least one handle flap of the plurality of handle flaps of the first handle portion extending adjacent the first access opening; and the second handle portion comprises the second access opening in at least the bottom panel, at least one handle flap of the plurality of handle flaps of the second handle portion extending adjacent the second access opening.

4. The carton of claim 3, wherein:

the at least two end flaps comprise a top end flap foldably connected to the top panel and at least one side end flap foldably connected to at least one of the first side panel and the second side panel; and the plurality of handle flaps of the first handle portion comprises a first handle flap foldably connected to the top end flap and at least one second handle flap foldably connected to the at least one side end flap, the first handle flap extending adjacent the first access opening, the at least one second handle flap at least partially overlapping the first handle flap.

5. The carton of claim 4, wherein:

the at least two end flaps further comprise a bottom end flap foldably connected to the bottom panel; and the plurality of handle flaps of the second handle portion comprises a third handle flap foldably connected to the bottom end flap and at least one fourth handle flap foldably connected to the at least one side end flap, the third handle flap extending adjacent the second access opening, the at least one fourth handle flap at least partially overlapping the third handle flap.

6. The carton of claim 5, wherein:

the at least two end flaps are respectively foldably connected to the panels of the plurality of panels along a first lateral fold line;

the first handle flap is foldably connected to the top end flap along a second lateral fold line, the at least one second handle flap is foldably connected to the at least one side end flap along at least one first curved fold line, the third handle flap is foldably connected to the bottom panel along a third lateral fold line, and the at least one fourth handle flap is foldably connected to the at least one side end flap along at least one second curved fold line; and the at least one first curved fold line at least partially overlaps the second lateral fold line, and the at least one second curved fold line at least partially overlaps the third lateral fold line.

7. The carton of claim 1, wherein the at least two end flaps comprise a top end flap foldably connected to the top panel and a bottom end flap foldably connected to the bottom panel, the first handle portion comprising a first handle flap foldably connected to the top end flap, and the second handle portion comprising a second handle flap foldably connected to the bottom end flap.

8. The carton of claim 7, wherein the access opening comprises a first access opening and a second access opening;

the first handle portion comprises the first access opening in at least the top panel, and the second handle portion comprises the second access opening in at least the bottom panel, the first handle flap extending adjacent the first access opening, and the second handle flap extending adjacent the second access opening.

9. The carton of claim 8, wherein the at least two end flaps further comprise a first side end flap foldably connected to the first side panel and a second side end flap foldably connected to the second side panel, each of the first side end flap and the second side end flap at least partially overlapping the top end flap and the bottom end flap.

10. The carton of claim 9, wherein:

the first handle portion comprises a third handle flap foldably connected to the first side end flap and a fourth handle flap foldably connected to the second side end flap, each of the third handle flap and the fourth handle flap at least partially overlapping the first handle flap; and the second handle portion comprises a fifth handle flap foldably connected to the first side end flap and a sixth handle flap foldably connected to the second side end flap, each of the fifth handle flap and the sixth handle flap at least partially overlapping the second handle flap.

11. The carton of claim 1, wherein the handle is a first handle, and the carton further comprises a second handle extending in at least the top panel, the second handle being spaced apart from the closed end of the carton.

12. A blank for forming a carton, the blank comprising:

a plurality of panels comprising a top panel, a bottom panel, a first side panel, and a second side panel;

at least two end flaps respectively foldably connected to respective panels of the plurality of panels, the at least two end flaps for being at least partially overlapped with respect to one another to at least partially form a closed end of the carton formed from the blank; and handle features for forming a handle extending in at least the closed end of the carton formed from the blank, the handle features comprising a first handle portion adjacent the top panel and a second handle portion adjacent the bottom panel;

wherein at least one of the first handle portion and the second handle portion comprise an access opening and a handle flap; the access opening being in one of the top panel and the bottom panel.

13. The blank of claim 12, wherein the handle flap comprises a plurality of handle flaps; each of the first handle portion and the second handle portion comprises the plurality of handle flaps foldably connected to the at least two end flaps.

14. The blank of claim 13, wherein:

the access opening comprises a first access opening and a second access opening;

the first handle portion comprises the first access opening in at least the top panel, at least one handle flap of the plurality of handle flaps of the first handle portion extending adjacent the first access opening; and the second handle portion comprises the second access opening in at least the bottom panel, at least one handle flap of the plurality of handle flaps of the second handle portion extending adjacent the second access opening.

15. The blank of claim 14, wherein:

the at least two end flaps comprise a top end flap foldably connected to the top panel and at least one side end flap foldably connected to at least one of the first side panel and the second side panel; and the plurality of handle flaps of the first handle portion comprises a first handle flap foldably connected to the top end flap and at least one second handle flap foldably connected to the at least one side end flap, the first handle flap extending adjacent the first access opening, the at least one second handle flap being for at least partially overlapping the first handle flap when the carton is formed from the blank.

16. The blank of claim 15, wherein:

the at least two end flaps further comprise a bottom end flap foldably connected to the bottom panel; and the plurality of handle flaps of the second handle portion comprises a third handle flap foldably connected to the bottom end flap and at least one fourth handle flap foldably connected to the at least one side end flap, the third handle flap extending adjacent the second access opening, the at least one fourth handle flap being for at least partially overlapping the third handle flap when the carton is formed from the blank.

17. The blank of claim 16, wherein:

the at least two end flaps are respectively foldably connected to the panels of the plurality of panels along a first lateral fold line;

the first handle flap is foldably connected to the top end flap along a second lateral fold line, the at least one second handle flap is foldably connected to the at least one side end flap along at least one first curved fold line, the third handle flap is foldably connected to the bottom panel along a third lateral fold line, and the at least one fourth handle flap is foldably connected to the at least one side end flap along at least one second curved fold line; and the at least one first curved fold line is for at least partially overlapping the second lateral fold line when the carton is formed from the blank, and the at least one second curved fold line is for at least partially overlapping the third lateral fold line when the carton is formed from the blank.

18. The blank of claim 12, wherein the at least two end flaps comprise a top end flap foldably connected to the top panel and a bottom end flap foldably connected to the bottom panel; the handle flap comprises a first handle flap and a second handle flap, the first handle portion comprising the first handle flap foldably connected to the top end flap, and the second handle portion comprising the second handle flap foldably connected to the bottom end flap.

19. The blank of claim 18, wherein the access opening comprises a first access opening and a second access opening; the first handle portion comprises the first access opening in at least the top panel, and the second handle portion comprises the second access opening in at least the bottom panel, the first handle flap extending adjacent the first access opening, and the second handle flap extending adjacent the second access opening.

20. The blank of claim 19, wherein the at least two end flaps further comprise a first side end flap foldably connected to the first side panel and a second side end flap foldably connected to the second side panel, and each of the first side end flap and the second side end flap is for at least partially overlapping the top end flap and the bottom end flap when the carton is formed from the blank.

21. The blank of claim 20, wherein:

the first handle portion comprises a third handle flap foldably connected to the first side end flap and a fourth handle flap foldably connected to the second side end flap, each of the third handle flap and the fourth handle flap being for at least partially overlapping the first handle flap when the carton is formed from the blank; and the second handle portion comprises a fifth handle flap foldably connected to the first side end flap and a sixth handle flap foldably connected to the second side end flap, each of the fifth handle flap and the sixth handle flap being for at least partially overlapping the second handle flap when the carton is formed from the blank.

22. The blank of claim 12, wherein the handle features are first handle features, and the blank further comprises second handle features for forming a second handle when the carton is formed from the blank, the second handle features extending in at least the top panel and being spaced apart from the at least two end flaps.

23. A method of forming a carton comprising:

obtaining a blank comprising a plurality of panels comprising a top panel, a bottom panel, a first side panel, and a second side panel, at least two end flaps respectively foldably connected to respective panels of the plurality of panels, and handle features extending in at least the at least two end flaps;

forming an interior of the carton at least partially defined by the plurality of panels, the forming the interior of the carton comprising forming an open-ended sleeve; and positioning the at least two end flaps to be at least partially overlapped with respect to one another to at least partially close an end of the open-ended sleeve, the positioning the at least two end flaps comprising positioning the handle features to form a handle in the closed end with a first handle portion adjacent the top panel and a second handle portion adjacent the bottom panel, wherein at least one of the first handle portion and the second handle portion comprise an access opening and a handle flap; the access opening being in one of the top panel and the bottom panel.

24. The method of claim 23, wherein:

the at least two end flaps comprise a top end flap foldably connected to the top panel and a bottom end flap foldably connected to the bottom panel;

the access opening comprises a first access opening and a second access opening;

the handle flap comprises a first handle flap and a second handle flap, the first handle portion comprises the first handle flap foldably connected to the top end flap and the first access opening in at least the top panel, the first handle flap extending adjacent the first access opening; and the second handle portion comprises the second handle flap foldably connected to the bottom end flap and the second access opening in at least the bottom panel, the second handle flap extending adjacent the second access opening.

25. The method of claim 24, wherein:

the at least two end flaps further comprise a first side end flap foldably connected to the first side panel and a second side end flap foldably connected to the second side panel; and the positioning the at least two end flaps further comprises folding each of the first side end flap and the second side end flap to at least partially overlap the top end flap and the bottom end flap when the carton is formed from the blank.

26. The method of claim 25, wherein:

the first handle portion comprises a third handle flap foldably connected to the first side end flap and a fourth handle flap foldably connected to the second side end flap;

the second handle portion comprises a fifth handle flap foldably connected to the first side end flap and a sixth handle flap foldably connected to the second side end flap; and the positioning the handle features to form the handle further comprises positioning each of the third handle flap and the fourth handle flap to at least partially overlap the first handle flap, and positioning each of the fifth handle flap and the sixth handle flap to at least partially overlap the second handle flap.

27. The method of claim 26, further comprising:

activating the handle by folding at least the first handle flap and the second handle flap relative to a central portion of the closed end to form a respective first handle opening and second handle opening, the first handle opening comprising the first access opening, and the second handle opening comprising the second access opening, and grasping the central portion of the closed end at the first handle opening and the second handle opening.

* * * * *